US006298905B1

(12) United States Patent
Kaell et al.

(10) Patent No.: US 6,298,905 B1
(45) Date of Patent: Oct. 9, 2001

(54) CONTINUOUS CASTING EQUIPMENT

(75) Inventors: Norbert Kaell, Differdange; Charles Assa, Dondelange; Rudy Petry, Muensbach; Emile Lonardi, Bascharage, all of (LU)

(73) Assignee: Paul Wurth S.A., Rue de d'Alsace (LU)

( * ) Notice: Subject to any disclaimer, the term of this patent is extended or adjusted under 35 U.S.C. 154(b) by 0 days.

(21) Appl. No.: 09/450,224

(22) Filed: Nov. 29, 1999

Related U.S. Application Data

(63) Continuation of application No. PCT/EP98/03134, filed on May 28, 1998.

(30) Foreign Application Priority Data

May 30, 1997 (LU) ..... 90071

(51) Int. Cl.[7] ..... B22D 11/04

(52) U.S. Cl. ..... 164/416; 164/478; 164/443; 164/459; 164/485; 164/418

(58) Field of Search ..... 164/416, 478, 164/443, 459, 485, 418

(56) References Cited

U.S. PATENT DOCUMENTS

| | | | |
|---|---|---|---|
| 5,642,769 | 7/1997 | Thone et al. | 164/416 |
| 5,676,194 | 10/1997 | Petry et al. | 164/416 |
| 5,715,888 | 2/1998 | Kaell et al. | 164/416 |

FOREIGN PATENT DOCUMENTS

| | | |
|---|---|---|
| 195 47 780 | 6/1996 | (DE) . |
| WO 95/03904 | 2/1995 | (WO) . |
| WO 95/05910 | 3/1995 | (WO) . |
| WO 97/26099 | 7/1997 | (WO) . |

*Primary Examiner*—Tom Dunn
*Assistant Examiner*—Kevin McHenry
(74) *Attorney, Agent, or Firm*—Smith, Gambrell & Russell LLP

(57) ABSTRACT

The invention relates to a continuous casting device comprising a support structure (16, 116), a swing lever (24, 124) which is pivotally mounted in the support structure (16, 166) around a first pivotal axis a drive mechanism (34, 134) which is connected to said swing lever (24, 124) and a continuous casting shell (14, 114) which can be impinged upon a cooling medium. A bearing (38, 138) to support the continuous cast shell (14, 114) is pivotally mounted on the swing lever (24, 124) around a second pivotal axis, whereby at least one connection for the cooling medium is integrated into the pivoting bearing (38, 138).

35 Claims, 5 Drawing Sheets

10

CONTINUOUS CASTING EQUIPMENT

This application is a continuation of PCT/EP98/03134 having an International filing date of May 28, 1998 and which is incorporated herein by reference in its entirety.

FIELD OF THE INVENTION

The invention relates to continuous casting equipment, in particular continuous casting equipment with an integrated vibrating device.

BACKGROUND OF THE INVENTION

It is known how to vibrate the mould in the casting direction to prevent adherence of the billet to the cooled inner walls of the casting pipe in the continuous casting of metals, in particular in the continuous casting of steel.

A conventional vibrating device of continuous casting equipment comprises a lifting table, on which the continuous casting mould is arranged as a unit. These lifting tables are relatively heavy and in addition require quite a large amount of space under the mould, where this space is not always available.

The international patent application WO 95/03904 describes a mould which has a fixed casing, to which a casting pipe is connected via two flexibly deformable annular sealing diaphragms in such a way that it can vibrate in the casing along the casting axis. The annular sealing diaphragms seal an annular pressure chamber for a cooling liquid around the casting pipe. The casting pipe comprises at its top end lateral bearing journals, with which it is suspended in an oscillating lever. The latter is pivoted about a horizontal axis in the casing. A lever arm is led through a seal from the pressure chamber and connected to a lifting cylinder, which generates the vibrations. With this mould the weight of the parts to be vibrated and thus the power input are greatly reduced. A disadvantage of this mould is that changing of the casting pipe is relatively time-consuming, because the annular sealing diaphragms must first be dismantled.

International patent application WO 95/05910 describes a compact vibrating device, which has an annular lifting cylinder, into which a mould consisting of a casting pipe and a cooling box can be suspended axially. The cooling box of the mould is connected via flexible pipe connections to fixed connection pieces for the purpose of connection to a cooling water circuit.

SUMMARY OF THE INVENTION

The present application is based on the task of producing continuous casting equipment with an integrated compact vibrating device, whereby it should be possible to connect the continuous casting mould to be vibrated particularly easily to a cooling circuit when changing it. This problem is solved by continuous casting equipment according to the present invention.

Continuous casting equipment according to the invention comprises a supporting structure, an oscillating lever, which is pivoted about a first swivelling axis in this supporting structure, a drive connected to the oscillating lever and a continuous casting mould, which can be supplied with a cooling medium. A bearing for supporting the mould is pivoted about a second axis in the oscillating lever. At least one connection for a cooling medium is integrated in the bearing. The mould is supported by the bearing and is detachably connected to the at least one connection for the cooling medium, so that it can easily be installed and dismantled as a unit, whereby the pivoted bearing remains mounted on the oscillating lever during dismantling of the mould and the cooling medium connection integrated in the bearing can consequently remain connected to an external cooling circuit. Consequently no flexible pipe connection need be broken and re-established between an external cooling circuit and the pivoted mould when changing the mould. It should also be noted that the oscillating lever with a vibrating bearing with an integrated connection for the cooling medium is an extremely compact vibrating device.

In a preferred embodiment of the continuous casting equipment, first connection means are integrated in the swivelling bearing and second connection means in the mould, these first and second connection means being complementary to each other in such a way that they interact when the mould is placed on the swivelling bearing to form a sealed transition for the cooling medium. The mould can accordingly be connected to an external cooling circuit without separately assembled pipes by simply mounting the mould on the swivelling bearing.

The bearing can be formed by a collector ring, which is pivoted in the oscillating lever. The mould is placed in this collector ring and sealed by top and bottom sealing means in relation to the collector ring, so that the collector ring and sealing means form an annular collector around the mould. In an advantageous embodiment these sealing means comprise a top and bottom sealing flange on the mould, the top sealing flange resting by means of a first seal on a top sealing face of the collector ring and the bottom sealing flange by means of a second seal on a bottom sealing face of the collector ring, the top sealing flange being larger than the bottom sealing flange. Consequently the mould can easily be placed from above in the collector ring. The mould advantageously has an annular sealing rib between the upper and lower sealing flanges, which rests with a seal on an inner surface of the collector ring in order to separate a feed chamber and a return chamber in the connection collector.

In an alternative embodiment the bearing comprises a first connection plate, in which at least one cooling medium connection forms a first opening, which is enclosed by a first sealing face. A second connection plate with at least one second opening for introduction or removal of a cooling medium is arranged on the mould. When the mould rests on the bearing in the operating position, the two openings are in alignment with each other, and a second sealing face, which encloses the second opening and is complementary to the first opening, is pressed against the first sealing face to form a seal. At least one of the two sealing faces opposite each other is advantageously formed by a ring which can be displaced axially against a spring element. In this embodiment satisfactory sealing is also ensured if more than one opening has to be sealed. For example, the first connection plate on the bearing and the second connection plate on the mould can each have at least one opening for a cooling medium feed and cooling medium return flow.

A mould for the continuous casting equipment described above advantageously has a projection, in which the second connection plate is integrated. A suitable bearing can then have two parallel supporting arms for the mould, the first connection plate connecting the two supporting arms in such a way that a forked bearing is formed for the mould.

The first and second sealing faces resting on each other are preferably essentially horizontal, so that the weight of the mould and the tensile force on the billet contribute to the generation of a contact force between the sealing faces.

The continuous casting mould advantageously rests with its top end on the swivelling bearing, guide means being arranged on the bottom end of the continuous casting mould to guide it in the supporting structure. These guide means may, for example, comprise a guide ring or a guide rod.

To achieve a particularly compact construction the second swivelling axis can be formed by swivel joints arranged between the first swivelling axis and the point of application of the drive on the oscillating lever. However, these swivel joints can also be arranged at one end of the oscillating lever.

Cooling medium connections integrated in the swivelling bearing can be connected by compensators to fixed connections of an external cooling circuit. A particularly long life of these compensators is achieved if they are installed in such a way that their central axis is essentially parallel with the stroke direction, which can be accomplished particularly easily in equipment according to the invention.

However, cooling medium connections integrated in the swivelling bearing can also be connected via ducts in the oscillating lever to an external cooling circuit. These ducts can each be connected to a fixed connection piece on the supporting structure via a first swivel joint connection arranged coaxially with the first swivelling axis and to the connections in the bearing via a second swivel joint connection arranged coaxially with the second swivelling axis.

If an electromagnetic agitator is provided, this is preferably supported directly by the supporting structure. The drive of the oscillating lever advantageously comprises a hydraulic cylinder, which rests with one end on the supporting structure and with its other end on the oscillating lever.

BRIEF DESCRIPTION OF THE DRAWINGS

Exemplified embodiments of the invention are explained with the aid of the enclosed schematic drawings.

DETAILED DESCRIPTION OF THE PREFERRED EMBODIMENTS

All the figures relate to continuous casting equipment according to the invention, as can be used, for example, for continuous casting of steel billets.

Figure 1:
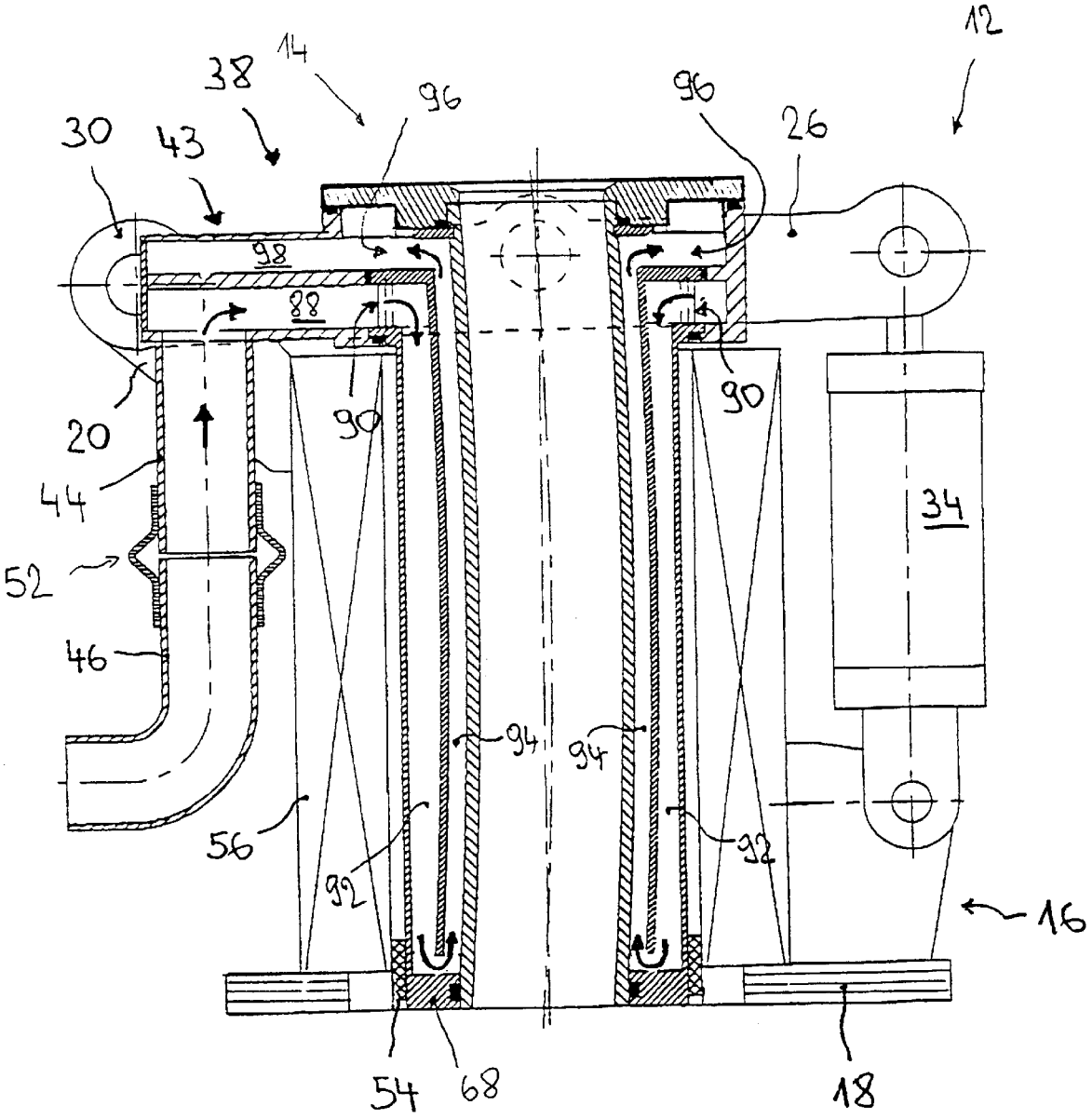
FIG. 1 shows a longitudinal section through a first embodiment of continuous casting equipment according to the invention.
Figure 2:
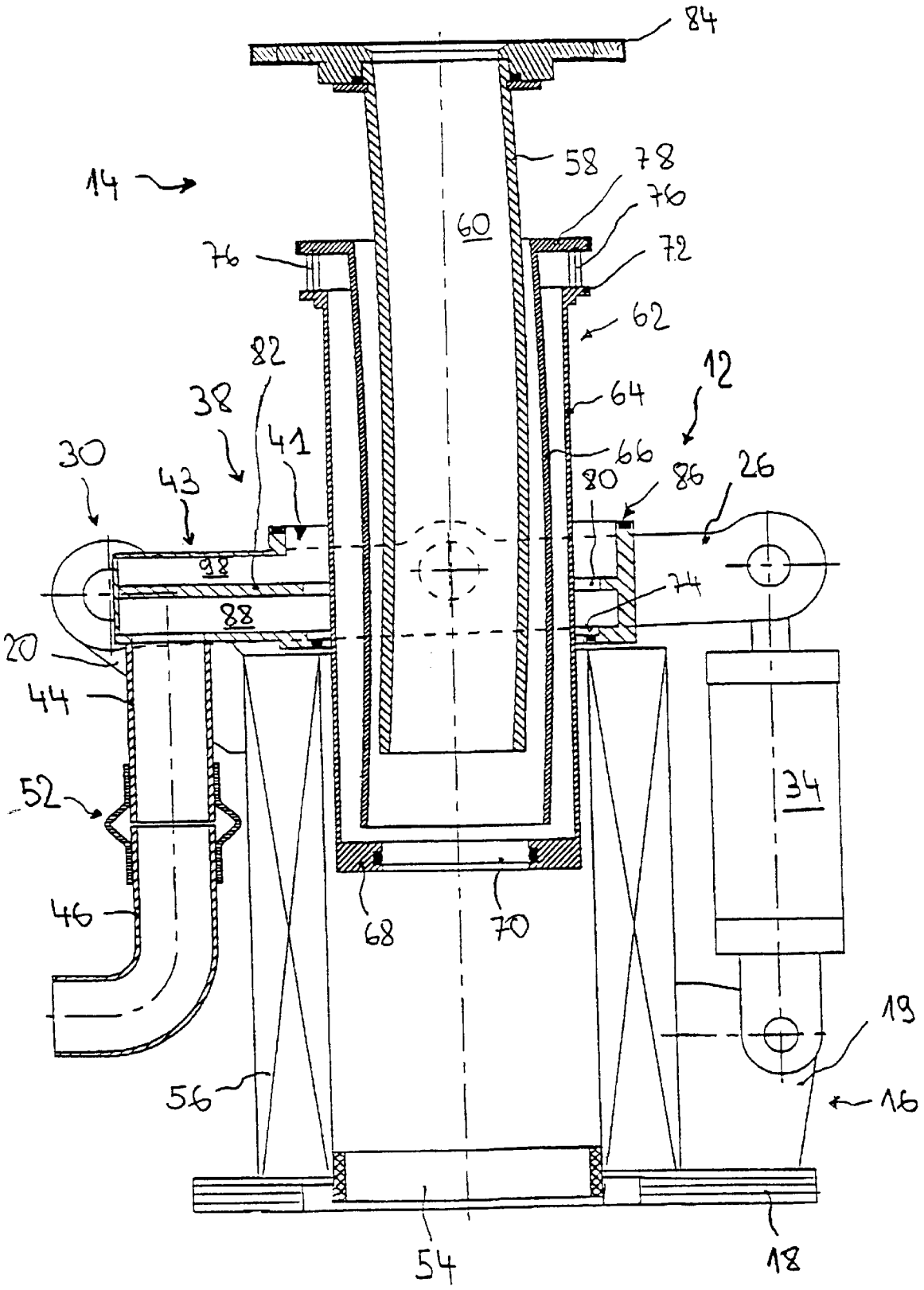
FIG. 2 a longitudinal section through the equipment in FIG. 1, the most important components of the equipment being shown separately.
Figure 3:
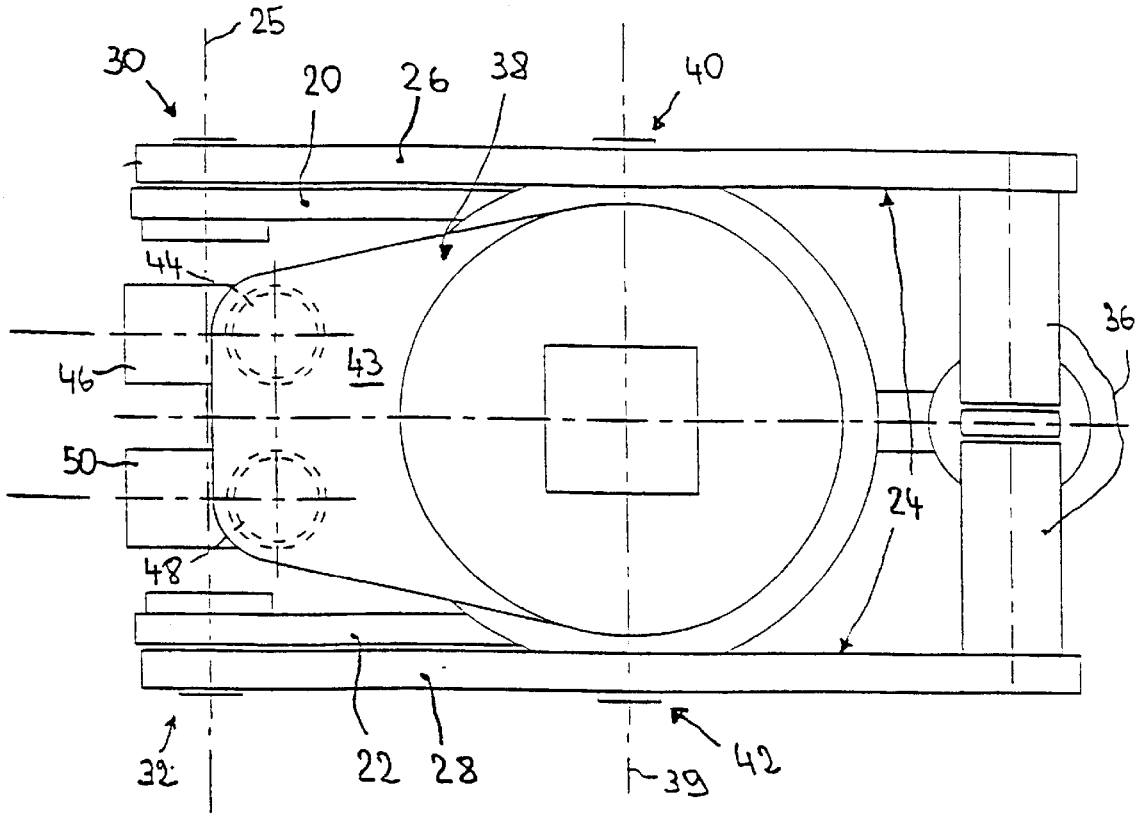
FIG. 3 a plan view of the continuous casting equipment in FIG. 1.
Figure 5:
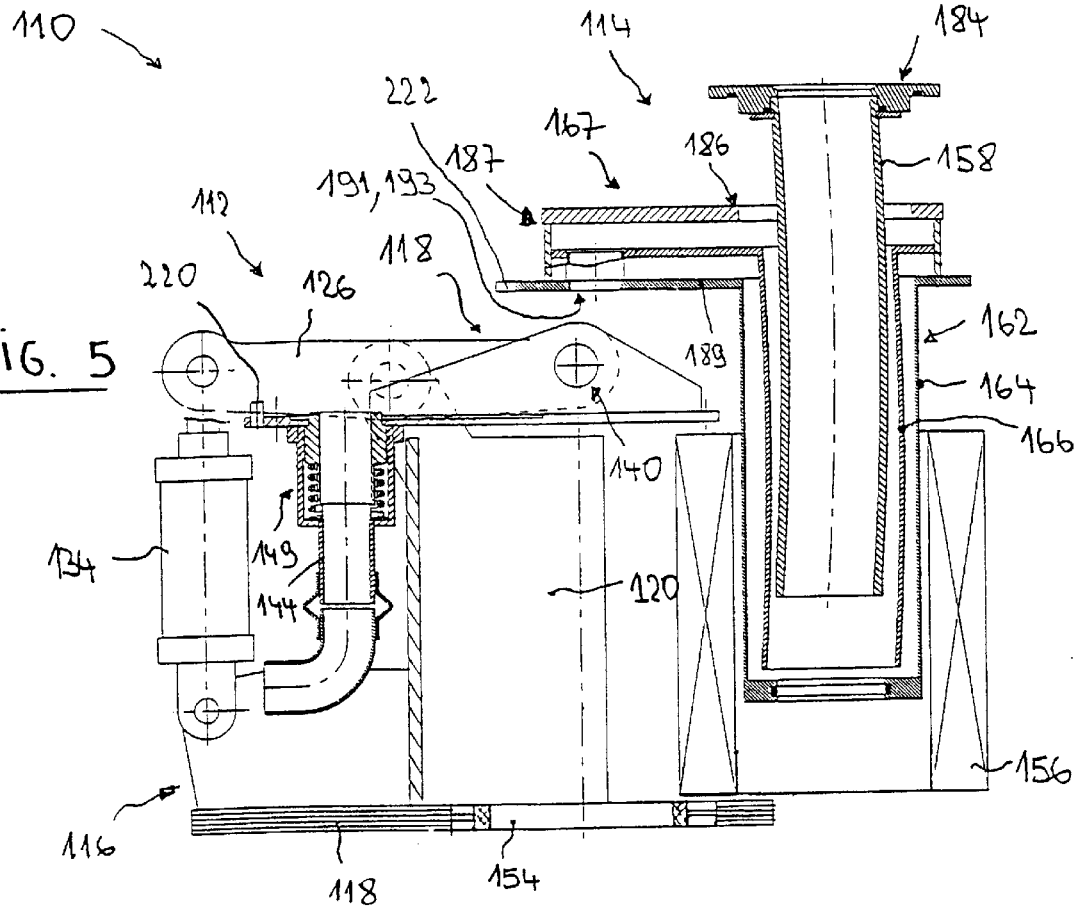
FIG. 5 a longitudinal section through the equipment in FIG. 4, the most important components of the equipment being drawn separately.

A first embodiment of such equipment is shown schematically in FIGS. 1 to 3 and designated 10. It consists essentially of a compact vibrating device 12, in which a continuous casting mould 14 (shaded portion in the drawing) is suspended. This continuous casting equipment is shown ready for operation in FIGS. 1 and 3, i.e. the continuous casting mould 14 is inserted or suspended in the vibrating device 12. By contrast, the main components of the equipment 10 are shown individually before assembly in FIG. 2.

The vibrating device comprises a supporting structure 16 with a base 18 and a superstructure 19, the latter forming two symmetrically arranged supporting arms 20, 22 at its top end (see in particular FIG. 3). A two-armed rocking lever 24 is pivoted about a horizontal axis 25 in the supporting arms 20, 22. The two lever arms 26, 28, each of which is connected mechanically at one end via a pivot bearing 30, 32 to one of the two supporting arms 20, 22, are shown in FIG. 3. At the opposite end the oscillating lever 24 is connected to a drive 34, which produces a swivelling movement of the oscillating lever 24 about the swivelling axis 25. The drive 34 is advantageously designed as a hydraulic cylinder, which is mounted between the base 18 and a transverse connection 36 of the two lever arms 26, 28.

In the two-armed rocking lever 24 a bearing 38 for the mould 14 is pivoted about a horizontal axis 39 (see FIG. 3). This swivelling axis 39, which is essentially parallel with the swivelling axis 25, is formed by two pivot bearings 40, 42, which are arranged in the two lever arms 26, 28. As shown in FIG. 2, the swivelling bearing 38 comprises a collector ring 41, into which the mould 14 is inserted with a seal. A connection box on the collector ring 41, which has a connection piece 44 for a cooling medium feed pipe 46 and a connection piece 48 (see FIG. 3) for a cooling medium return pipe 50, is designated 43. Axial compensators 52 connect the connection pieces 44 or 48, which can be swivelled with the bearing 38, to the fixed cooling medium feed pipe 46 or the cooling medium return pipe 50. It can be seen that the central axis of the compensators 52 is essentially parallel with the swivelling movement of the mould 14, so that they have to absorb essentially axial movements. A guide ring on the supporting structure 16, into which the bottom end of the mould 14 is inserted (see FIG. 1), is designated 54. This guide ring 54 determines the alignment of the mould 14 supported by the swivelling bearing 38 during vibration and likewise absorbs the horizontal forces which act on the continuous casting mould 14 during continuous casting. An electromagnetic agitator 56, which is supported by the supporting structure 16 and encloses the mould, is designated 56 in FIGS. 1 and 2.

The construction of the mould 14 is described in more detail with the aid of FIG. 2, in which it is shown dismantled. It consists essentially of a casting pipe 58, which forms the actual casting duct 60, and a cooling box 62, which encloses the casting pipe 58 over its full length when the mould 14 is assembled. The cooling box 62 comprises essentially an outer shell 64 and an inner guide shell 66, which is arranged between the outer shell 64 and the casting pipe 58 in the assembled mould 14. At its bottom end the outer shell 64 has a base plate 68 with an opening 70 for sealed fitting of the bottom end of the casting pipe 58 (see also FIG. 1). At its top end the outer shell 64 has a sealing flange 72, which can be mounted with a seal on a bottom sealing ring 74 of the collector ring 41 (see FIG. 1). The guide shell 66 is secured by means of straps on the outer shell 64. Above the sealing flange 72 the guide shell 66 has an annular sealing rib 78, which can be fitted with a seal into an opening 80 in an intermediate plate 82 of the annular collector 40 (see FIG. 1). A sealing flange 84 is secured at the top end of the casting pipe 58. This flange can be placed on a top sealing face 86 of the connection box 43 (see FIG. 1).

The cooling circuit of the mould 14 will now be described in more detail with the aid of FIG. 1. The cooling medium, usually cooling water, flows from the feed pipe 46 via the feed connection piece 44 into a bottom feed chamber 88 in the connection box 43 of the annular collector 40. This feed chamber 88 encloses a lateral annular gap 90, which is formed between the bottom sealing flange 74 and the sealing rib 78 of the mould 14. The cooling medium flows via this annular gap 90 from the feed chamber 88 of the bearing 38 into the mould 14, where it is guided through an annular duct 92 between the outer shell 64 and the guide shell 66 to the bottom end of the mould 14, where it flows via a gap between the guide shell 66 and the base plate 68 into an annular duct 94 between the guide shell 66 and the casting pipe 58. The cooling medium flows back through the annular duct 94 to the top end of the mould 14 and cools the casting pipe 58. At the top end of the mould the cooling medium flows through a lateral annular gap 96 between the sealing rib 78 and the top sealing flange 84 of the mould 14 and then from the latter into a return chamber 98, which encloses the annular gap 96 and extends into the connection box 43. The cooling medium finally flows back into the return pipe 50 via the return connection piece 50, which discharges into the top return chamber 98.

An alternative embodiment of the invention is described with the aid of FIGS. 4 to 8. The continuous casting equipment 110 likewise consists of a compact vibrating device 112 and a continuous casting mould 114 (see FIG. 5, in which the main components of the vibrating device are shown separately), which is inserted into the vibrating device 112 (see FIG. 4, in which the vibrating device is shown in the operating condition). The vibrating device 112 comprises a supporting structure 116 with a base 118. A pair of supporting arms 120, 122 arranged symmetrically with the mould 114 extends upwards from the base 118 (see in particular FIGS. 6 and 7). A two-armed rocking lever 124 is pivoted in the supporting arms 120, 122 about a horizontal axis 125. The two lever arms 126, 128, which are each connected mechanically in the centre via a pivot bearing 130, 132 to one of the two supporting arms 120, 122, can be seen in FIG. 7. At one end, the oscillating lever 124 is connected to a drive 134, which produces a swivelling movement of the oscillating lever 124 about the swivelling axis 125. The drive 134 is advantageously designed as a hydraulic cylinder, which is mounted between the base 118 and a transverse connection 136 of the two lever arms 126, 128.

Figure 7:
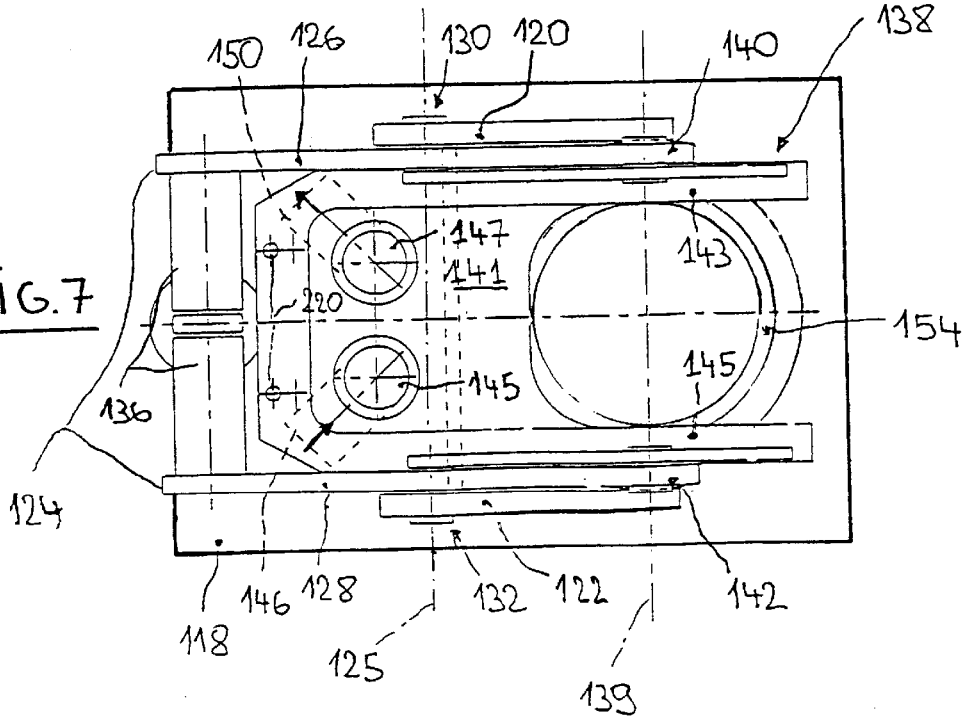
FIG. 7 a plan view of the vibrating device of the continuous casting equipment according to FIG. 4.

A bearing 138 for the mould 114 is pivoted about a horizontal axis 139 at the other end of the two-armed rocking lever 124 (see FIG. 7). The bearing comprises a connection plate 141 and two lateral supporting arms 143, 145, a forked bearing for the mould 114 being formed, as shown in FIG. 7. The swivelling axis 139, which is essentially parallel with the swivelling axis 125, is formed by two pivot bearings 140, 142, each of which connects one of the two supporting arms 143, 145 to one of the two lever arms 126, 128. Two openings 145, 147 for a cooling medium are arranged in the connection plate 141 (see FIG. 7). The first opening 145 terminates via a sealing device 149 described further below in a connection piece 144 for a cooling medium feed pipe 146. The second opening 147 terminates via a similar sealing device 149 in a connection piece 148 (see FIG. 6) for a cooling medium return pipe 150. A guide ring 154 on the supporting structure 116 corresponds to the guide ring 54 described above. The reference number 156 indicates an electromagnetic agitator.

Like mould 14, mould 114 also consists essentially of a casting pipe 158 and a cooling box 162. The cooling box 162 with its outer shell 164 and guide shell 166 differs from the cooling box 62 described above essentially by a connection box 167 at its top end. The remainder of the cooling box 162 is otherwise identical with the cooling box 62. The casting pipe 158 inserted in the cooling box 162 is likewise identical with the casting pipe 58 of the equipment 10. A sealing flange 184 mounted at the top end of the casting pipe 158 is placed with a seal on a top sealing face 186 on the connection box 167 of the cooling box 162 (see FIG. 4).

The connection box 167 has a lateral projection 187, which is closed at the bottom by a connection plate 189 with two openings 191, 193 for a cooling medium. When the mould 114 rests on the bearing 138 in the operating position (see FIG. 4), these openings 191, 193 in the connection plate 189 are aligned above the openings 145, 147 in the connection plate 141 of the bearing 138, complementary sealing faces, which enclose the individual openings 145, 147, 191, 193, being pressed against each other with a seal.

The sealing faces which enclose the openings 145, 147 in the connection plate 141 of the bearing 138 are advantageously formed by the already mentioned sealing devices 149. The latter are described in more detail with the aid of FIG. 8. They each comprise a ring 200, which is axially movable in a bush 202, a sealing ring 204 sealing the ring 200 in relation to the bush 202. The bush 202 is mounted on the connection plate 141, and the connection piece 144 (or 148) is connected with a seal to the bush 202. A spring 206, which forces the ring 200 in the direction of the connection plate 141, is arranged in the bush 202, a shoulder area 208 on the ring 200 fixing an end position of the ring, in which the front end of the ring 200 projects with a sealing face 210 from the connection plate 141. Hence when the mould 114 is inserted in the bearing 138, the connection plate 189 of the mould 114 first comes into contact with the sealing faces 210 of the two sealing devices 149. The rings 200 are pressed against the springs 206 in their bushes 202, until the connection plate 189 rests on its seat on the connection plate 141. The springs 206 pretensioned in this way thus ensure an initial contact pressure of the sealing faces 210 on the opposite sealing faces on the connection plate 189. When the cooling system is operated, the cooling medium under pressure flows through the bush 202. It generates an additional hydrostatic contact pressure by applying pressure to the rear end face 212 of the ring 200.

Figure 4:
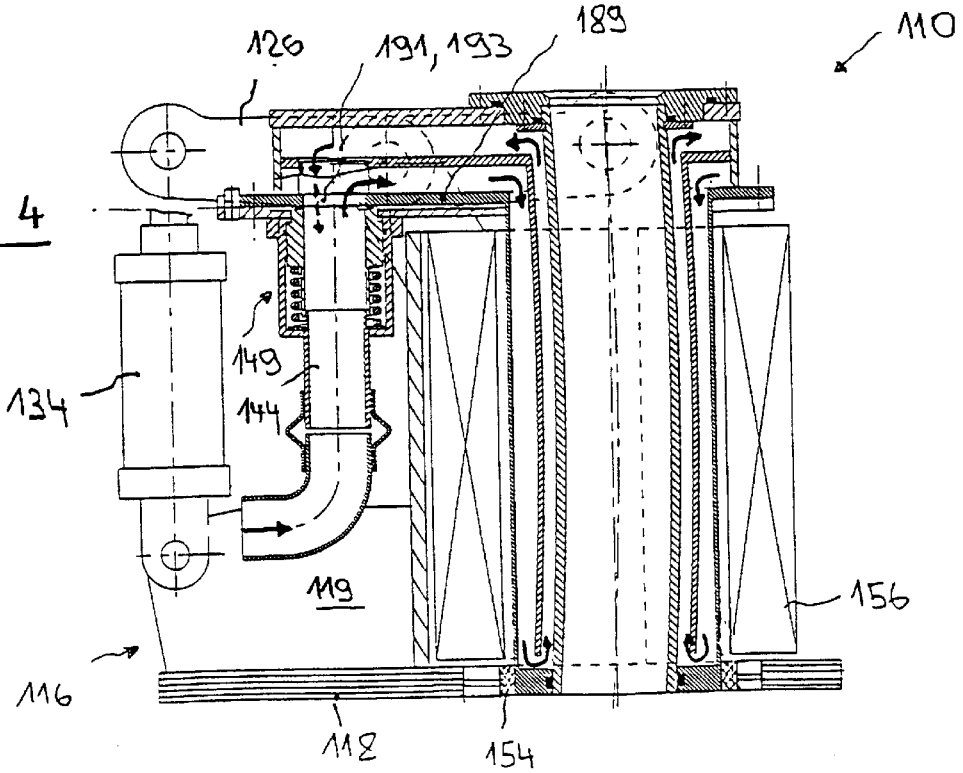
FIG. 4 a longitudinal section through a second embodiment of continuous casting equipment according to the invention.
Figure 6:
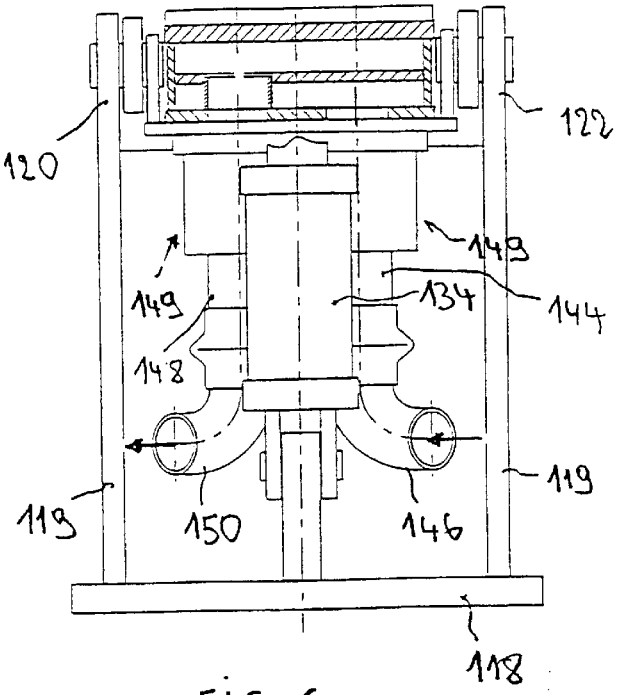
FIG. 6 a side view of the continuous casting equipment according to FIG. 4, the connection box of the mould being drawn as a section.
Figure 8:
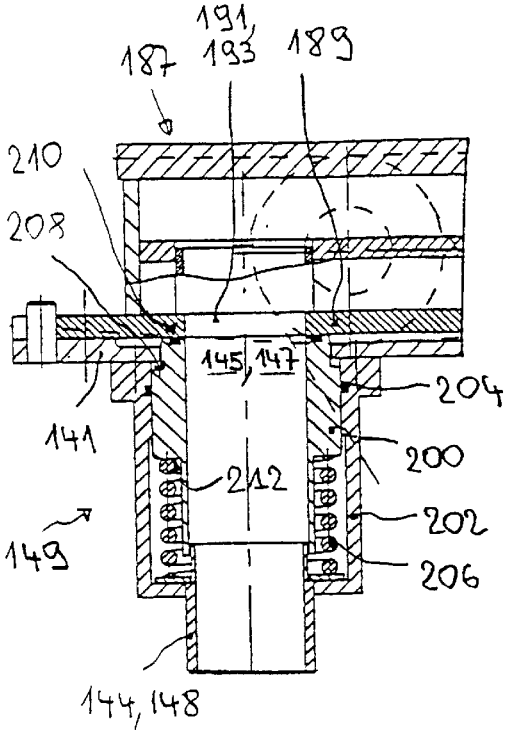
FIG. 8 an enlarged section from FIG. 4.

The cooling circuit of the mould 114 is indicated by arrows in FIG. 4, as in FIG. 1. It is pointed out that the cooling circuit of the mould 114 suspended in the vibrating device 112 is essentially identical with the cooling circuit of the mould 14 suspended in the vibrating device 12 in FIG. 1.

It should finally be noted that in the device 110 the mould 114 can be introduced laterally into the vibrating device 112. Centering means, e.g. centering pins 220 and centering holes 222, permit simple centering of the mould on the bearing 138. The oscillating lever 124 could, of course, also be designed like the oscillating lever 24, i.e. with an end swivelling axis, which would permit more compact design of the equipment 110. However, with this alternative embodiment the end drive would make the lateral introduction of the mould 114 into the vibrating device more difficult.

In the present specification the invention has been described, for example, with a mould 144, 114 with a casting pipe. However, it is clear to the expert that the invention can also be constructed with plate moulds.

What is claimed is:

1. Continuous casting equipment comprising a supporting structure, an oscillating lever, which is pivoted about a first swivelling axis in the supporting structure, a drive connected to the oscillating lever, a continuous casting mould, to which a cooling medium can be fed, and a bearing for supporting the continuous casting mould, which is pivoted about a second swivelling axis in the oscillating lever, at least one connection for the cooling medium being integrated in the swivelling bearing.

2. Continuous casting equipment according to claim 1, characterized by the integration of first connection means for the cooling medium in the swivelling bearing and second connection means in the mould, these first and second connection means being of complementary design in such a way that they interact to form a sealed transition for the cooling medium when the mould is placed on the swivelling bearing.

3. Continuous casting equipment according to claim 1, characterised in that the swivelling bearing comprises a collector ring, the mould being inserted into this collector ring and sealed by top and bottom sealing means in relation to the collector ring in such a way that the collector ring and the sealing means form an annular collector around the mould inserted in the swivelling collector ring.

4. Continuous casting equipment according to claim 3, wherein the sealing means comprise a top sealing flange and a bottom sealing flange on the mould, the top sealing flange resting with a seal on a top sealing face of the collector ring and the bottom sealing flange with a seal on a bottom sealing face of the collector ring, the top sealing flange being larger than the bottom sealing flange.

5. Continuous casting equipment according to claim 4, wherein the mould has an annular sealing rib between the top and bottom sealing flange, this sealing rib resting with a radial seal on an inner face of the collector ring, so that it separates a feed chamber and a return chamber, which extend into a connection box on the bearing.

6. Continuous casting equipment according to claim 1, further comprising:

a first connection plate on the bearing, in which at least one cooling medium connection forms a first opening, which is enclosed by a first sealing face;

a second connection plate on the mould with at least one second opening for feed or return of a cooling medium, which is enclosed by a second sealing face complementary to the first sealing face;

the two openings being aligned with each other and the second sealing face pressed with a seal against the first sealing face, when the mould rests in operating position on the bearing.

7. Continuous casting equipment according to claim 6, wherein one of the two sealing faces is formed by a ring, which is axially movable against a spring element.

8. Continuous casting equipment according to claim 7, wherein a pressure area is arranged on the ring in such a way that it receives the cooling medium and a compressive force is generated, which presses the two sealing faces resting on each other together.

9. Continuous casting equipment according to claim 6, wherein the first connection plate on the bearing and the second connection plate on the mould each have at least one opening for a cooling medium feed pipe and one opening for a cooling medium return pipe.

10. Continuous casting equipment according to claim 9, wherein the mould has a projection, into which the second connection plate is integrated.

11. Continuous casting equipment according to claim 10, wherein the bearing has two parallel supporting arms for the mould, the first connection plate connecting the two supporting arms in such a way that a forked bearing for the mould is formed.

12. Continuous casting equipment according to claim 6, wherein the first and second sealing faces resting on each other are essentially horizontal.

13. Continuous casting equipment according to claim 1, wherein the continuous casting mould rests with its top end on the bearing, wherein guide means, which guide the bottom end of the continuous casting mould in the supporting structure, are arranged on the bottom end of the continuous casting mould.

14. Continuous casting equipment according to claim 1, wherein the second swivelling axis is formed by pivot joints, which are arranged on the oscillating lever between the first swivelling axis and the point of application of the drive.

15. Continuous casting equipment according to claim 1, wherein the connection for the cooling medium, which is integrated in the swivelling bearing, is connected by compensators to fixed pipes, the central axis of these compensators being essentially parallel with the stroke direction.

16. Continuous casting equipment according to claim 1, further comprising an electromagnetic agitator, which encloses the continuous casting mould and is supported directly by the supporting structure.

17. Continuous casting equipment according to claim 1, wherein the drive of the oscillating lever comprises a hydraulic cylinder.

18. A continuous casting equipment comprising:

a supporting structure;

an oscillating lever, which is pivoted about a first swivelling axis in said supporting structure;

a drive connected to said oscillating lever;

a continuous casting mould equipped with a cooling circuit;

a swivelling bearing for removably supporting said continuous casting mould, said swivelling bearing being pivoted about a second swivelling axis in said oscillating lever; and at least one cooling medium connection integrated in said swivelling bearing for connecting said cooling circuit of said continuous casting mould thereto.

19. The continuous casting equipment according to claim 18, including: first connection means for said cooling medium integrated in said swivelling bearing; and second connection means for said cooling medium integrated in said mould; wherein said first and second connection means are of complementary design so that they co-operate to form a sealed cross-over for said cooling medium when said mould is placed on said swivelling bearing.

20. The continuous casting equipment according to claim 18, wherein:

said continuous casting mould has a top end and a bottom end and rests with its top end on said swivelling bearing; and said continuous casting equipment further includes guide means for guiding said bottom end of said continuous casting mould in said supporting structure.

21. The continuous casting equipment according to claim 19, further including:

two pivot joints forming said second swivelling axis, said pivot joints being arranged on said oscillating lever between said first swivelling axis and the connection point of said drive.

22. The continuous casting equipment according to claim 18, further including:

at least one fixed cooling medium pipe; and a compensator connecting said at least one connection for the cooling medium to said at least one fixed cooling medium pipe;

wherein said compensator has a central axis that is essentially parallel to the movement of said continuous casting mould.

23. The continuous casting equipment according to claim 18, further comprising:

an electromagnetic agitator, which encloses said continuous casting mould and is supported directly by said supporting structure.

24. The continuous casting equipment according to claim 18, wherein said drive comprises a hydraulic cylinder.

25. A continuous casting equipment comprising:

a supporting structure;

an oscillating lever, which is pivoted about a first swivelling axis in said supporting structure;

a drive connected to said oscillating lever;

a continuous casting mould equipped with a cooling circuit;

a swivelling bearing for supporting said continuous casting mould, said swivelling bearing being pivoted about a second swivelling axis in said oscillating lever;

a collector ring integrated in said swivelling bearing, said collector ring surrounding said continuous casting mould when the latter is supported by said swivelling bearing; and sealing means co-operating with said collector ring and said mould so as to form a sealed annular collector around said mould.

26. The continuous casting equipment according to claim 25, wherein said sealing means includes:

a top sealing flange and a bottom sealing flange on said continuous casting mould;

a top sealing face and a bottom sealing face on said collector ring;

wherein said top sealing flange rests in a sealed manner on said top sealing face, said bottom sealing flange rests in a sealed manner on said bottom sealing face, and said top sealing flange is larger than said bottom sealing flange.

27. The continuous casting equipment according to claim 26, wherein:

said continuous casting mould has an annular sealing rib between said top sealing flange and said bottom sealing flange;

said collector ring having an inner cylindrical surface; and a radial seal provides a sealed connection between said annular sealing rib and said inner cylindrical surface, when said continuous casting mould is supported by said swivelling bearing, so that said collector ring is partitioned in a separate feed chamber and a separate return chamber.

28. The continuous casting equipment according to claim 27, wherein:

said swivelling bearing further includes a connection box in fluid communication with said feed chamber and said return chamber.

29. A continuous casting equipment comprising:

a supporting structure;

an oscillating lever, which is pivoted about a first swivelling axis in said supporting structure;

a drive connected to said oscillating lever;

a continuous casting mould equipped with a cooling circuit;

a swivelling bearing for supporting said continuous casting mould, said swivelling bearing being pivoted about a second swivelling axis in said oscillating lever;

a first connection plate on said swivelling bearing, with at least one first opening for feed or return of a cooling medium, said at least one first opening being enclosed by a first sealing face;

a second connection plate on said continuous casting mould, with at least one second opening for feed or return of a cooling medium, said at least one second opening being enclosed by a second sealing face, and said second sealing face being complementary to said first sealing face;

wherein said at least one first opening is aligned with said at least one second opening, and said second sealing face is pressed in a sealed manner against said first sealing face, when said continuous casting mould is supported by said swivelling bearing.

30. A continuous casting equipment according to claim 29, further comprising:

an axially movable ring element forming one of said first or second sealing face; and a spring element associated with said ring element, so as to bias the sealing face formed by said ring into contact with the other sealing face, when said continuous casting mould is supported by said swivelling bearing.

31. Continuous casting equipment according to claim 30, wherein:

a pressure shoulder is provided on said ring in such a way that a cooling medium flowing through said ring acts on said pressure shoulder and generates a pressure force pressing said two sealing faces together.

32. The continuous casting equipment according to claim 29, wherein said first connection plate and said second connection plate each have at least one opening cooling medium feed and at least one opening for cooling medium return.

33. The continuous casting equipment according to claim 29, wherein: said mould has a lateral projection, into which said second connection plate is integrated.

34. The continuous casting equipment according to claim 33, wherein: said swivelling bearing has two parallel supporting arms for said mould, said first connection plate connecting said two supporting arms in such a way that a forked bearing for said mould is formed.

35. The continuous casting equipment according to claim 29, wherein said first and second sealing faces are essentially horizontal when said continuous casting mould is supported by said swivelling bearing.

* * * * *